US009121117B2

(12) United States Patent
Teramoto et al.

(10) Patent No.: US 9,121,117 B2
(45) Date of Patent: Sep. 1, 2015

(54) BEADING LOOM

(71) Applicant: CLOVER MFG. CO., LTD., Osaka-shi, Osaka (JP)

(72) Inventors: Yui Teramoto, Osaka (JP); Yasuhiro Fujiwara, Osaka (JP)

(73) Assignee: CLOVER MFG. CO. LTD., Osaka (JP)

( * ) Notice: Subject to any disclaimer, the term of this patent is extended or adjusted under 35 U.S.C. 154(b) by 0 days.

(21) Appl. No.: 14/098,785

(22) Filed: Dec. 6, 2013

(65) Prior Publication Data

US 2014/0166150 A1 Jun. 19, 2014

(30) Foreign Application Priority Data

Dec. 14, 2012 (JP) ..... 2012-273292
Dec. 14, 2012 (JP) ..... 2012-273293
Dec. 14, 2012 (JP) ..... 2012-273294

(51) Int. Cl.
*D03D 29/00* (2006.01)
*D04D 1/04* (2006.01)
*D04D 9/04* (2006.01)
*D03D 41/00* (2006.01)

(52) U.S. Cl.
CPC ..... *D03D 29/00* (2013.01); *D04D 1/04* (2013.01); *D04D 9/04* (2013.01)

(58) Field of Classification Search
CPC ..... D03D 29/00; D04B 3/00
See application file for complete search history.

(56) References Cited

U.S. PATENT DOCUMENTS 737,073 A * 8/1903 Bush ..... 28/151
829,474 A * 8/1906 Hooper ..... 139/33
1,160,132 A * 11/1915 Bliss ..... 139/33
1,277,927 A * 9/1918 Heiss ..... 139/33.5
2,094,505 A * 9/1937 Thackeray ..... 139/33
2,139,879 A * 12/1938 Clark et al. ..... 139/33
2,150,187 A * 3/1939 Raba et al. ..... 139/33
2,166,415 A * 7/1939 Lervad ..... 139/33
2,190,813 A * 2/1940 Walker ..... 28/151
2,228,438 A * 1/1941 Brooks ..... 139/33
2,241,199 A * 5/1941 Hines et al. ..... 139/33
2,242,210 A * 5/1941 Gallinger ..... 139/33
2,253,329 A * 8/1941 Gallinger ..... 139/33
2,601,222 A * 6/1952 Wehrli ..... 28/151
2,802,255 A * 8/1957 Wallach ..... 28/151

(Continued)

FOREIGN PATENT DOCUMENTS

JP 52-038268 3/1977
JP 06-006469 1/1994

(Continued)

*Primary Examiner* — Bobby Muromoto, Jr.

(74) *Attorney, Agent, or Firm* — Hamre, Schumann, Mueller & Larson, P.C.

(57) ABSTRACT

A beading loom includes two side supports spaced apart in a lateral direction, and a plurality of shafts rotatably connected to the supports. The shafts include first and second thread fixing shafts, and first and second thread supporting shafts. Each of the first and second thread supporting shafts includes first and second thread supporting portions elongated in the lateral direction. In each thread supporting shaft, the first and the second thread supporting portions are provided at different positions in the circumferential direction of the shaft. Each of the first and the second thread supporting portions includes a plurality of grooves arranged at a pitch in the lateral direction. The pitch of the grooves of the first thread supporting portion differs from the pitch of the grooves of the second thread supporting portion.

17 Claims, 17 Drawing Sheets

(56) References Cited

U.S. PATENT DOCUMENTS

| | | | | | |
|---|---|---|---|---|---|
| 3,137,320 | A | * | 6/1964 | Parton | 139/33 |
| 3,800,372 | A | * | 4/1974 | Daoust | 28/152 |
| 3,973,413 | A | * | 8/1976 | Tichenor | 66/1 A |
| 4,023,245 | A | * | 5/1977 | Zaltzman | 28/152 |
| 4,046,172 | A | * | 9/1977 | Russell | 139/33 |
| 4,074,726 | A | * | 2/1978 | Harris | 139/29 |
| 4,109,355 | A | * | 8/1978 | Davitian | 28/151 |
| 4,160,467 | A | * | 7/1979 | Woodruff | 139/33 |
| 4,192,046 | A | | 3/1980 | van den Bosch-Meevis et al. | |
| RE30,656 | E | * | 6/1981 | Davitian | 28/151 |
| 4,462,432 | A | * | 7/1984 | Sajo et al. | 139/33 |
| 4,832,085 | A | * | 5/1989 | Northrup | 139/34 |
| 5,413,150 | A | * | 5/1995 | Townsend | 139/34 |
| 6,149,437 | A | * | 11/2000 | Corliss | 434/95 |
| 6,453,951 | B1 | * | 9/2002 | Kuwabara | 139/33 |
| 8,066,035 | B1 | * | 11/2011 | Stevens | 139/29 |
| 2004/0055916 | A1 | * | 3/2004 | Faller et al. | 206/349 |
| 2005/0205150 | A1 | * | 9/2005 | Jenner et al. | 139/11 |
| 2006/0157137 | A1 | * | 7/2006 | Sayler | 139/29 |
| 2008/0173368 | A1 | * | 7/2008 | Flodin et al. | 139/33 |
| 2009/0126822 | A1 | * | 5/2009 | Kojima | 139/29 |
| 2009/0293982 | A1 | * | 12/2009 | Skaflestad | 139/34 |
| 2010/0269947 | A1 | * | 10/2010 | Spear | 139/29 |
| 2011/0259465 | A1 | * | 10/2011 | Schaub | 139/29 |
| 2012/0047960 | A1 | * | 3/2012 | Sasur | 66/1 A |
| 2013/0291994 | A1 | * | 11/2013 | Wijerama et al. | 139/29 |

FOREIGN PATENT DOCUMENTS

| | | |
|---|---|---|
| JP | 2000-355848 | 12/2000 |
| JP | 2002-88616 | 3/2002 |
| JP | 3103647 | 6/2004 |
| JP | 2007-63692 | 3/2007 |
| JP | 2008-111209 | 5/2008 |

* cited by examiner

BEADING LOOM

BACKGROUND OF THE INVENTION

1. Field of the Invention

The present invention relates to a bead-weaving loom used to make a fabric (beaded fabric) in which a plurality of beads; are woven.

2. Description of the Related Art

Conventionally, various types of bead-weaving looms or beading looms are known. For instance, the beading loom disclosed in Japanese unexamined utility model publication No. H06-6464 includes a pair of side plates, a pair of thread bars connected to the side plates, and a pair of spiral springs (thread holding bars) arranged between the thread bars. Each spiral spring holds a plurality of warp threads as spaced apart from each other. By using a beading loom of this type, as shown in FIG. 1 of the above-identified publication, weft threads on which beads are strung are combined with a plurality of warp threads, whereby a desired beaded fabric can be made. To make a relatively long beaded fabric, as shown in FIG. 2 of the publication, a warp thread is wound around one of the thread bars. Then, the thread bar is rotated to pay out the warp thread, while the other thread bar is rotated to wind up the warp thread (and hence wind up the woven portion).

Japanese unexamined utility model publication No. S52-39268 discloses a beading loom that is capable of changing the distance between a pair of thread holding bars. The beading loom disclosed in this publication includes a pair of frames connected slidably to each other via a seat plate. The paired thread holding bars are attached to the paired frames, respectively. The seat plate is provided with two left and right fastening screws. By tightening the two screws, the relative movement of the paired frames is prevented.

SUMMARY OF THE INVENTION

The present invention has been conceived under the above-described circumstances. It is therefore an object of the present invention to provide a beading loom that is improved in convenience.

According to a first aspect of the present invention, there is provided a beading loom comprising: a first side support structure and a second side support structure spaced apart from each other in a lateral direction; a first thread fixing shaft for fixing one end of each of a plurality of threads, the first thread fixing shaft being rotatably connected to the first side: support structure and the second side support structure; a second thread fixing shaft for fixing the other end of each of the threads, the second thread fixing shaft being spaced apart from the first thread fixing shaft in a longitudinal direction perpendicular to the lateral direction and rotatably connected to the first side support structure and the second side support structure; a first thread supporting shaft provided adjacent to the first thread fixing shaft to hold the threads as spaced apart from each other in the lateral direction, the first thread supporting shaft being positioned between the first thread fixing shaft and the second thread fixing shaft as viewed in a height direction perpendicular to both of the lateral direction and the longitudinal direction and rotatably connected to the first side support structure and the second side support structure; and a second thread supporting shaft provided adjacent to the second thread fixing shaft to hold the threads as spaced apart from each other in the lateral direction, the second thread supporting shaft being positioned between the first thread fixing shaft and the second thread fixing shaft as viewed in the height direction and rotatably connected to the first side support structure and the second side support structure. Each of the first and second thread supporting shafts includes a first and a second thread supporting portions elongated in the lateral direction. The first and the second thread supporting portions are provided at different positions in a circumferential direction of the thread supporting shaft. Each of the first and the second thread supporting portions includes a plurality of grooves arranged at a predetermined pitch in the lateral direction. The pitch of the grooves of the first thread supporting portion differs from the pitch of the grooves of the second thread supporting portion.

Preferably, in the first aspect, each of the grooves of the first thread supporting portion and the grooves of the second thread supporting portion has a V-shaped cross section.

Preferably, in the first aspect, each of the first and the second thread supporting shafts has a cylindrical outer circumferential surface. Each of the first and the second thread supporting portions of each of the thread supporting shafts projects radially outward from the outer circumferential surface of the thread supporting shaft.

Preferably, in the first aspect, each of the first and the second thread supporting portions of each of the thread supporting shafts is formed with a plurality of through-holes having a common axis extending in the lateral direction.

Preferably, in the first aspect, the beading loom further comprises a first thread hook bar to be removably attached to the first thread supporting shaft and a second thread book bar to be removably attached to the second thread supporting shaft.

Preferably, in the first aspect, the first thread hook bar is provided between the first thread supporting portion and the second thread supporting portion in the circumferential direction of the first thread supporting shaft.

Preferably, in the first aspect, the beading loom further comprises an operation mechanism provided at each of the first and the second thread supporting shafts. Each of the thread supporting shafts includes a first end and a second end spaced apart from each other. The operation mechanism of each of the thread supporting shafts includes a threaded shaft which is provided at the first end and which rotates with the thread supporting shaft, a first operational portion which is provided at the second end and which rotates with the thread supporting shaft, and a second operational portion including a threaded hole meshing with the threaded shaft. The first side support structure and the second side support structure are provided between the first operational portion and the second operational portion.

According to a second aspect of the present invention, there is provided a beading loom comprising: a first side plate and a second side plate spaced apart from each other in a lateral direction; a third side plate and a fourth side plate spaced apart from the first side plate and the second side plate, respectively, in a longitudinal direction perpendicular to the lateral direction; a first thread fixing shaft for fixing one end of each of a plurality of threads, the first thread fixing shaft being connected to the first side plate and the second side plate; a second thread fixing shaft for fixing the other end of each of the threads, the second thread fixing shaft being connected to the third side plate and the fourth side plate; a first thread supporting shaft for holding the threads as spaced apart from each other in the lateral direction, the first thread supporting shaft being connected to the first side plate and the second side plate at a position adjacent to the first thread fixing shaft; a second thread supporting shaft for holding the threads as spaced apart from each other in the lateral direction, the second thread supporting shaft being connected to the third side plate and the fourth side plate at a position adjacent to the second thread fixing shaft; a first connecting member connecting the first side plate and the third side plate to each other; a second connecting member connecting the second side plate and the fourth side plate to each other; and a length adjustment mechanism for changing the distance between the first thread supporting shaft and the second thread supporting shaft stepwise by a predetermined pitch.

Preferably, in the second aspect, the length adjustment mechanism includes a plurality of grooves arranged at a predetermined pitch in the longitudinal direction and a protrusion for fitting in the grooves.

Preferably, in the second aspect, the grooves are provided at the first connecting member and the protrusion is provided at the first side plate.

Preferably, in the second aspect, the grooves are provided at the first side plate and the protrusion is provided at the first connecting member.

Preferably, in the second aspect, the grooves are connected to each other in the longitudinal direction and each has a V-shaped cross section, and the protrusion have a V-shaped cross section corresponding to the V-shaped cross section of the grooves.

Preferably, in the second aspect, the length adjustment mechanism includes an elongated hole provided at the first side plate and elongated in the longitudinal direction, a threaded hole provided at the first connecting member and facing the elongated hole, and a clamp bolt to be screwed into the threaded hole via the elongated hole.

Preferably, in the second aspect, the protrusion is provided on the outer side of the first connecting member in the lateral direction. The inner side of the first side plate in the lateral direction is formed with a guide groove for receiving the first connecting member movably in the longitudinal direction. The grooves are formed at the bottom of the guide groove.

Preferably, in the second aspect, the elongated hole is formed so as to cross the grooves, and the threaded hole is formed at a position corresponding to the protrusion as viewed in the lateral direction.

Preferably, in the second aspect, the outer side of the first side plate in the lateral direction is provided with a plurality of marks at positions corresponding to the grooves.

Preferably, in the second aspect, the first connecting member is provided with an additional protrusion spaced apart from the protrusion in the longitudinal direction.

According to a third aspect of the present invention, there is provided a heading loom comprising: a first side support structure and a second side support structure spaced apart from each other in a lateral direction; a first thread fixing shaft for fixing one end of each of a plurality of threads, the first thread fixing shaft being rotatably connected to the first side support structure and the second side support structure; a second thread fixing shaft for fixing the other end of each of the threads, the second thread fixing shaft being spaced apart from the first thread fixing shaft in a longitudinal direction perpendicular to the lateral direction and rotatably connected to the first side support structure and the second side support structure; a first thread supporting shaft rotatably connected to the first side support structure and the second side support structure at a position adjacent to the first thread fixing shaft, the first thread supporting shaft being provided for holding the threads as spaced apart from each other in the lateral direction; a second thread supporting shaft rotatably connected to the first side support structure and the second side support structure at a position adjacent to the second thread fixing shaft, the second thread supporting shaft being provided for holding the threads as spaced apart from each other in the lateral direction; and a first operation mechanism provided at the first thread fixing shaft. The first operation mechanism includes a first threaded shaft, a first operational portion and a second operational portion. The first threaded shaft projects to the outside of the first side support structure and rotates with the first thread fixing shaft. The first operational portion is provided on the outside of the second side support structure and rotates with the first thread fixing shaft. The second operational portion includes a threaded hole meshing with the first threaded shaft.

The first operational mechanism may be provided at the second thread fixing shaft.

Preferably, in the third aspect, the first thread fixing shaft has a first shaft hole penetrating the shaft in the lateral direction. The first operational mechanism includes a first shaft member which is inserted in the first shaft hole and which rotates with the first thread fixing shaft. The first shaft member has a first end at which the first threaded shaft is provided and a second end at which the first operational portion is provided.

Preferably, in the third aspect, the first thread fixing shaft includes a first end positioned adjacent to the first side support structure and a second end positioned adjacent to the second side support structure. The second end of the first thread fixing shaft is formed with a shaft end that is polygonal in cross section. The second end of the first shaft member is formed with a shaft member end that is polygonal in cross section. The first operational portion includes two polygonal recesses in which the shaft end and the shaft member end are fitted, respectively. According to this arrangement, each of the first thread fixing shaft and the first shaft member is unrotatable relative to the first operational portion.

Preferably, in the third aspect, the beading loom further includes a second operational mechanism provided at the first thread supporting shaft. The second operation mechanism includes a second threaded shaft, a third operational portion and a fourth operational portion. The second threaded shaft projects to the outside of the first side support structure and rotates with the first thread supporting shaft. The third operational portion is provided on the outside of the second side support structure and rotates with the first thread supporting shaft. The fourth operational portion includes a threaded hole meshing with the second threaded shaft.

The second operational mechanism may be provided at the second thread supporting shaft.

Preferably, in the third aspect, the first thread supporting shaft has a second shaft hole penetrating the shaft in the lateral direction. The second operational mechanism includes a second shaft member which is inserted in the second shaft hole and which rotates with the first thread supporting shaft. The second shaft member has a first end at which the second threaded shaft is provided and a second end at which the third operational portion is provided.

Other features and advantages of the present invention will become more apparent from detailed description given below with reference to the accompanying drawings.

DESCRIPTION OF THE PREFERRED EMBODIMENTS

Preferred embodiments of the present invention are described below with reference to the accompanying drawings.

Figure 1:
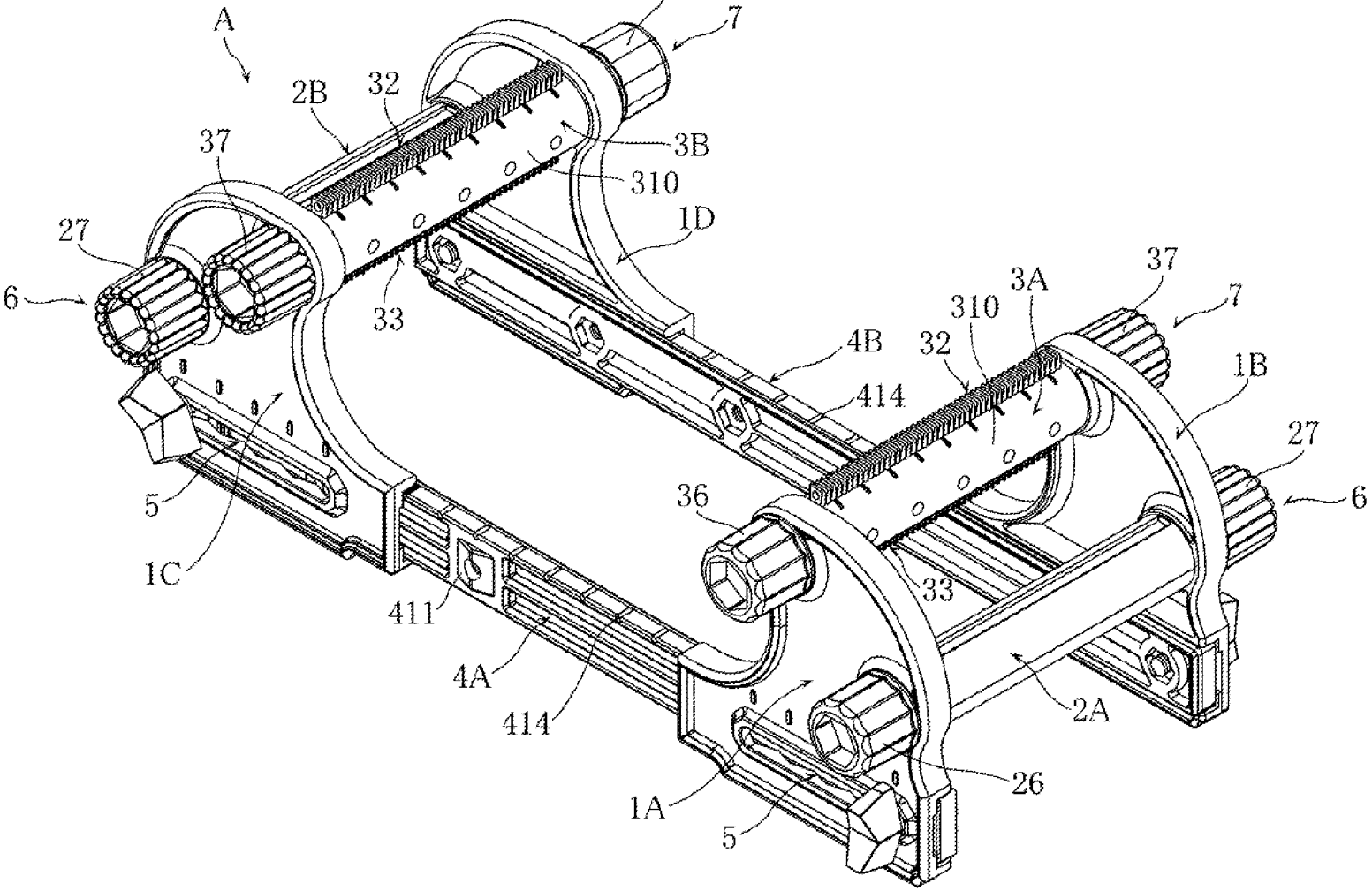
FIG. 1 is a perspective view of a beading loom according to an embodiment of the present invention.
Figure 2:
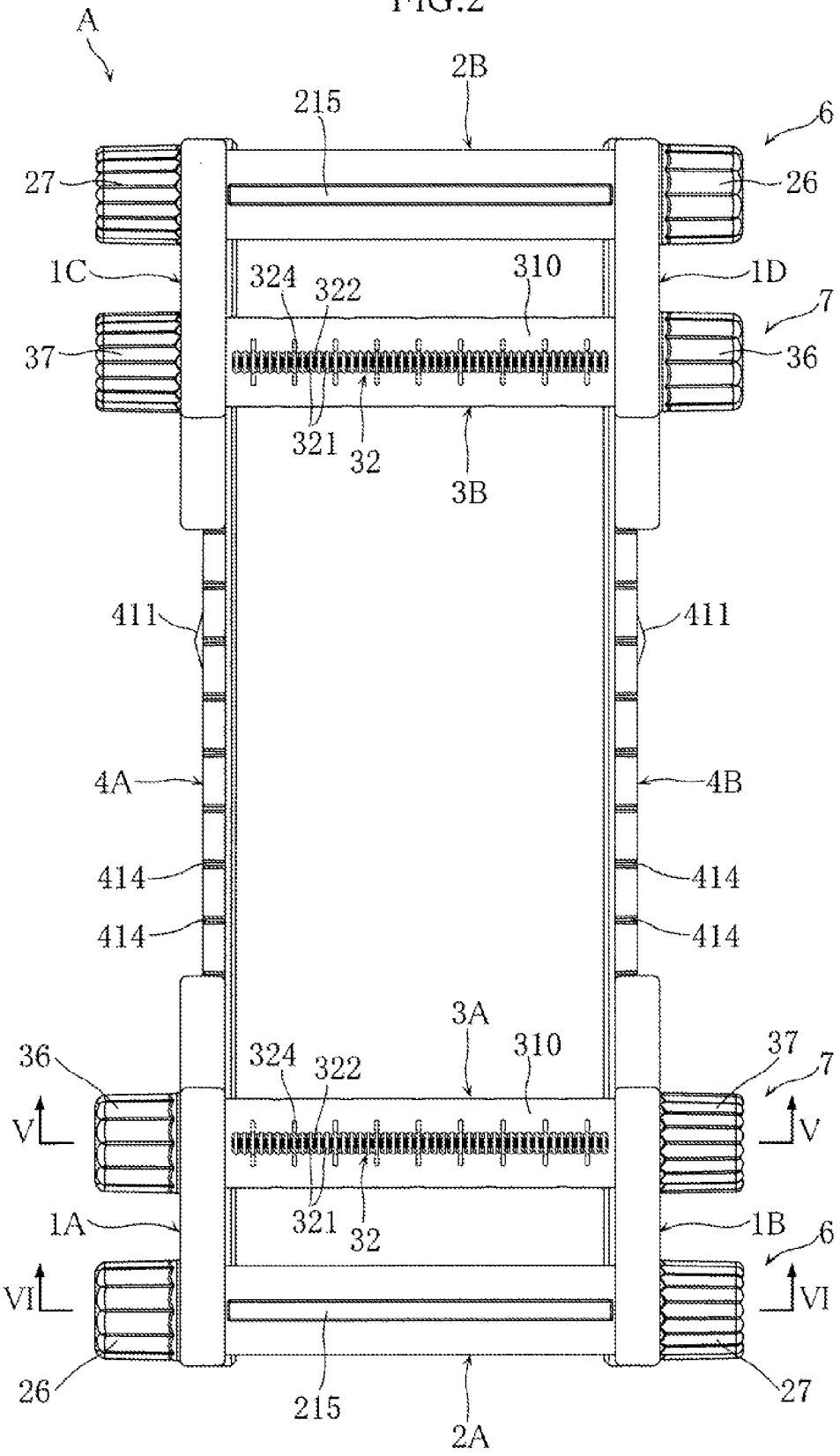
FIG. 2 is a plan view of the beading loom.

FIGS. 1-4 show a beading loom according to an embodiment of the present invention. As shown in FIGS. 1 and 2, the beading loom A of this embodiment includes a first and a second side support structures and a plurality of shafts rotatably connected to the support structures. Specifically, the first side support structure is made up of a left front side plate 1C, a left back side plate 1A, and a first connecting member 4A connecting the side plates 1C and 1A to each other. Similarly, the second side support structure is made up of a right front side plate 1D, a right back side plate 1B, and a second connecting member 4B connecting the side plates 1D and 1D to each other. The plurality of shafts include thread fixing shafts 2B, 2A and thread supporting shafts 3B, 3A. The beading loom A of this embodiment further includes a length adjustment mechanism 5 and operation mechanisms 6, 7.

The left front side plate 1C and the right front side plate 1D are spaced apart from each other by a predetermined distance in a lateral direction. The left back side plate 1A and the right back side plate 1B are spaced apart from the left front side plate 1C and the right front side plate 1D, respectively, in the longitudinal direction (perpendicular to the lateral direction) and spaced apart from each other by a predetermined distance in the lateral direction.

The thread fixing shaft 2B is used to fix one end of each of a plurality of warp threads. The opposite ends of the thread fixing shaft 2B in the axial direction (lateral direction) are connected to the two front side plates 1C and 1D, respectively. The thread fixing shaft 2A is used to fix the other end of each warp thread. The opposite ends of the thread fixing shaft 2A in the axial direction are connected to the two back side plates 1A and 1B, respectively. The two thread fixing shafts 2B and 2A are spaced apart from each other in the longitudinal direction.

The opposite ends of the thread supporting shaft 3B in the axial direction are connected to the two front side plates 1C, 1D at positions adjacent to the thread fixing shaft 2B. The opposite ends of the thread supporting shaft 3A in the axial direction are connected to the two back side plates 1A, 1B at positions adjacent to the thread fixing shaft 2A. The thread supporting shafts 3B and 3A are at positions higher than the thread fixing shafts 2B, 2A and between the thread fixing shafts 2B and 2A in the longitudinal direction.

The connecting member 4A connects the left front side plate 1C and the left back side plate 1A to each other. The connecting member 4B connects the right front side plate 1D and the right back side plate 1B to each other.

The structure of the thread fixing shaft 2A and the connecting structure of the thread fixing shaft 2A to the two back side plates 1A and 1B are described below.

Figure 5:
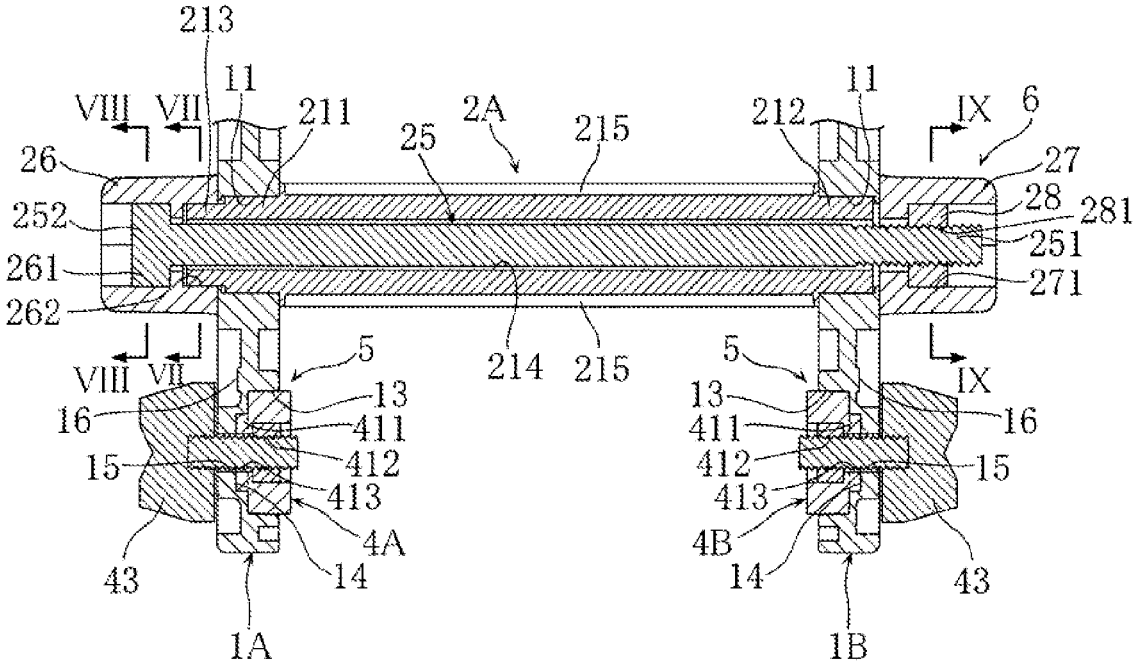
FIG. 5 is a sectional view taken along lines V-V in FIG. 2.
Figure 7:
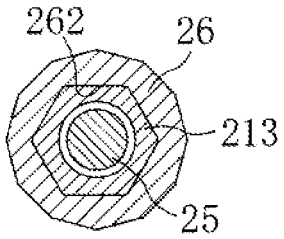
FIG. 7 is a sectional view taken along lines VII-VII in FIG. 5.

As shown in FIG. 5, the opposite ends of the thread fixing shaft 2A in the axial direction are provided with cylindrical rotational shafts 211 and 212. The rotational shafts 211 and 212 are received in the holes 11, 11 formed in the back side plates 1A and 1B, respectively. Thus, the thread fixing shaft 2A is rotatably supported on the two back side plates 1A and 1B. On the outside of the rotational shaft 211 in the axial direction is provided a shaft end 213. The shaft end 213 is polygonal in cross section and e.g. hexagonal for example (see FIG. 7). In the state in which the thread fixing shaft 2A is connected to the two back side plates 1A and 1B, the shaft end 213 projects to the outside of the left back side plate 1A. The thread fixing shaft 2A has a shaft hole 214 penetrating in the axial direction. The outer circumferential surface of the thread fixing shaft 2A is formed with a pair of axially extending recesses 215 (described later) for fixing warp threads.

Figure 8:
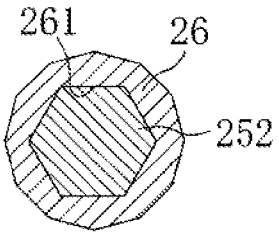
FIG. 8 is a sectional view taken along lines VIII-VIII in FIG. 5.
Figure 9:
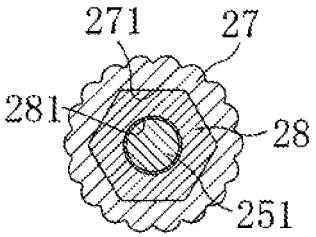
FIG. 9 is a sectional view taken along lines IX-IX in FIG. 5.

A shaft member 25 is inserted in the shaft hole 214 of the thread fixing shaft 2A. The shaft member 25 is in the form of a round bar provided with a threaded shaft 251 at its distal end. At the base end (left end in FIG. 5) of the shaft member 25, an end portion 252 that is polygonal in cross section is provided. For instance, the end portion 252 is hexagonal (see FIG. 8).

As shown in FIG. 5, an operational portion 26 is attached to the end portion 252. The operational portion 26 is on the outside of the left back side plate 1A. The operational portion 26 is formed with recesses 251 and 262. The recess 261 has a cross sectional shape corresponding to that of the end portion 252, and the end portion 252 is fitted in the recess 261. Thus, the operational portion 26 and the shaft member 25 are not rotatable relative to each other. In the recess 262 is fitted the shaft end 213. Thus, the operational portion 26 and the thread fixing shaft 2A are not rotatable relative to each other. As will be understood from these, the thread fixing shaft 2A, the shaft member 25 and the operational portion 26 are not rotatable relative to each other. Thus, when the operational portion 26 is rotated, the thread fixing shaft 2A and the shaft member 25 (threaded shaft 251) rotates together with the operational portion 26.

As shown in FIG. 5, an operational portion 27 is attached to the threaded shaft 251 of the shaft member 25. The operational portion 27 is formed with a recess 271. In this recess 271, a nut 28 having a threaded hole 281 is fitted. The threaded hole 281 meshes with the threaded shaft 251. According to this arrangement, when the operational portion 27 (nut 28) is turned in the direction to tighten the threaded shaft 251, the distance between the operational portions 26 and 27 reduces. This prevents rotation of the thread fixing shaft 2A sandwiched between the operational portions 26 and 27 via the two back side plates 1A and 1B relative to the two back side plates 1A and 1B. On the other hand, when the operational portion 27 (nut 28) is turned in the direction to loosen the threaded shaft 251, the distance between the operational portions 26 and 27 increases as shown FIG. 13. Thus, rotation of the thread fixing shaft 2A relative to the two back side plates 1A and 1B is allowed.

The structure of the thread fixing shaft 2B and the connecting structure of the thread fixing shaft 2B to the two front side plates 1C and 1D are substantially the same as those of the thread fixing shaft 2A. However, in the thread fixing shaft 2B, the shaft end 213 extends to the outside from the right front side plate 1D, and the operational portion 26 is provided on the outside of the right front side plate 1D (see e.g. FIG. 2). The operational portion 27 having a threaded hole 281 meshing with the threaded shaft 251 is provided on the outside of the left front side plate 1C.

The thread fixing shafts 2A and 2B having the above-described structure are made of e.g. a synthetic resin such as polyacetal resin. For instance, each of the thread fixing shafts 2A and 2B can be made by integrally bonding two members divided in the radial direction.

The operation mechanism 6 is a mechanism for rotating the thread fixing shafts 2A and 2B and includes the above-described shaft members 25 and the operational portions 26 and 27.

The structure of the thread supporting shaft 3A and the connecting structure of the thread supporting shaft 3A to the two back side plates 1A and 1B are described below.

Figure 6:
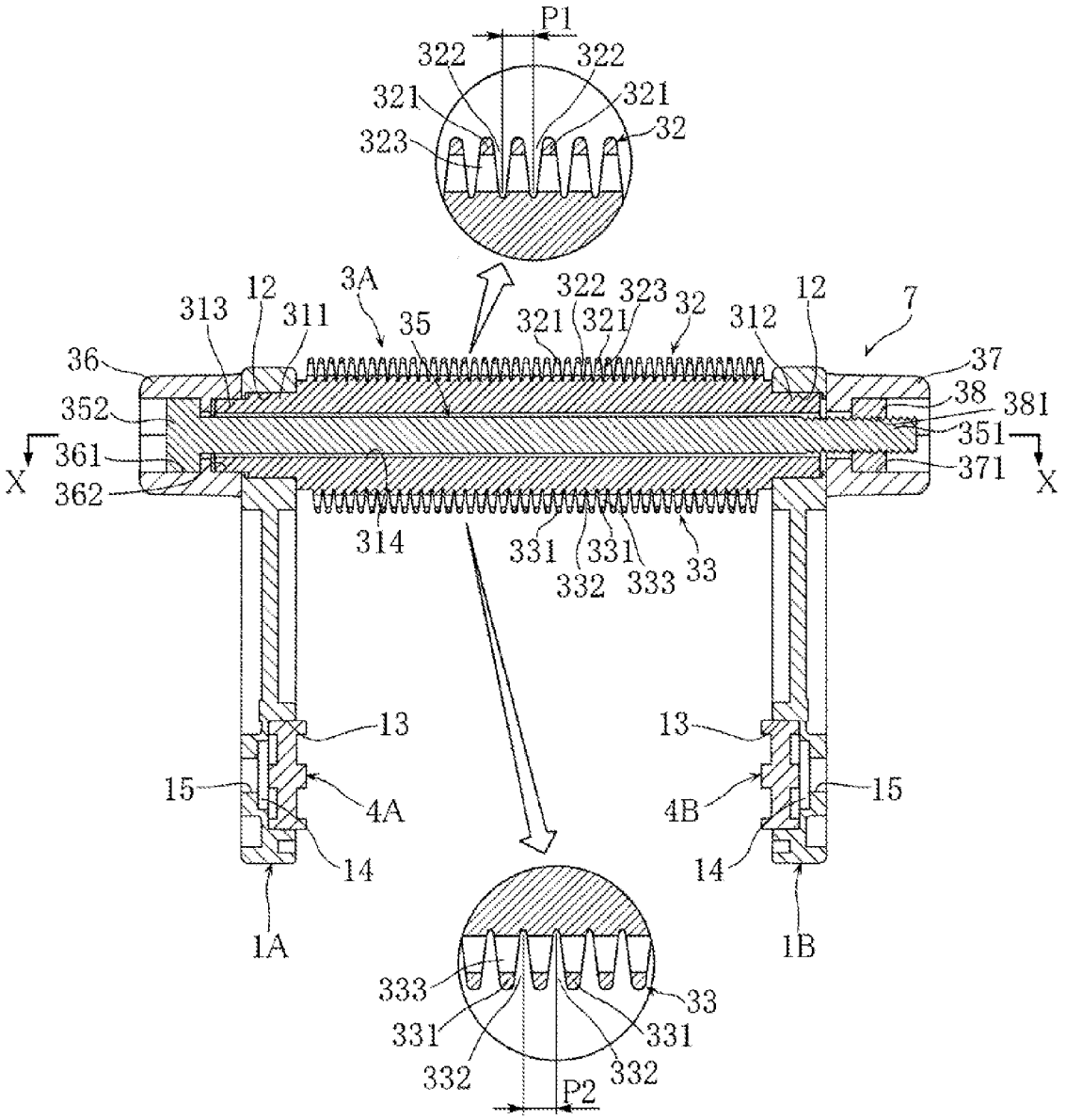
FIG. 6 is a sectional view taken along lines VI-VI in FIG. 2.

As shown in FIG. 6, the opposite ends of the thread supporting shaft 3A in the axial direction are provided with cylindrical rotational shafts 311 and 312. The rotational shafts 311 and 312 are received in the holes 12, 12 formed in the back side plates 1A and 1B, respectively. Thus, the thread supporting shaft 3A is rotatably supported on the two hack side plates 1A and 1B. On the left back side plate 1A side of the thread supporting shaft 3A, a shaft end 313 is provided on the outside of the rotational shaft 311 in the axial direction. The shaft end 313 is polygonal in cross section (e.g. hexagonal). In the state in which the thread supporting shaft 3A is connected to the two back side plates 1A and 1B, the shaft end 313 projects to the outside of the left back side plate 1A. The thread supporting shaft 3A has a shaft hole 314 penetrating in the axial direction.

A shaft member 35 is inserted in the shaft hole 314 of the thread supporting shaft 3A. The shaft member 35 is in the form of a round bar provided with a threaded shaft 351 at its distal end. At the base end of the shaft member 35, an end portion 352 that is polygonal (e.g. hexagonal) in cross section is provided. An operational portion 36 is attached to the end portion 352. The operational portion 36 is on the outside of the left back side plate 1A. The operational portion 36 is formed with recesses 361 and 362. The recess 361 has a cross sectional shape corresponding to that of the end portion 352, and the end portion 352 is fitted in the recess 361. Thus, the operational portion 36 and the shaft member 35 are not rotatable relative to each other. In the recess 362 is fitted the shaft end 313. Thus, the operational portion 36 and the thread supporting shaft 3A are not rotatable relative to each other. As will be understood from these, the thread supporting shaft 3A, the shaft member 35 and the operational portion 36 are not rotatable relative to each other. Thus, when the operational portion 36 is rotated, the thread supporting shaft 3A and the shaft member 35 (threaded shaft 351) rotate together with the operational portion 36.

Figure 14:
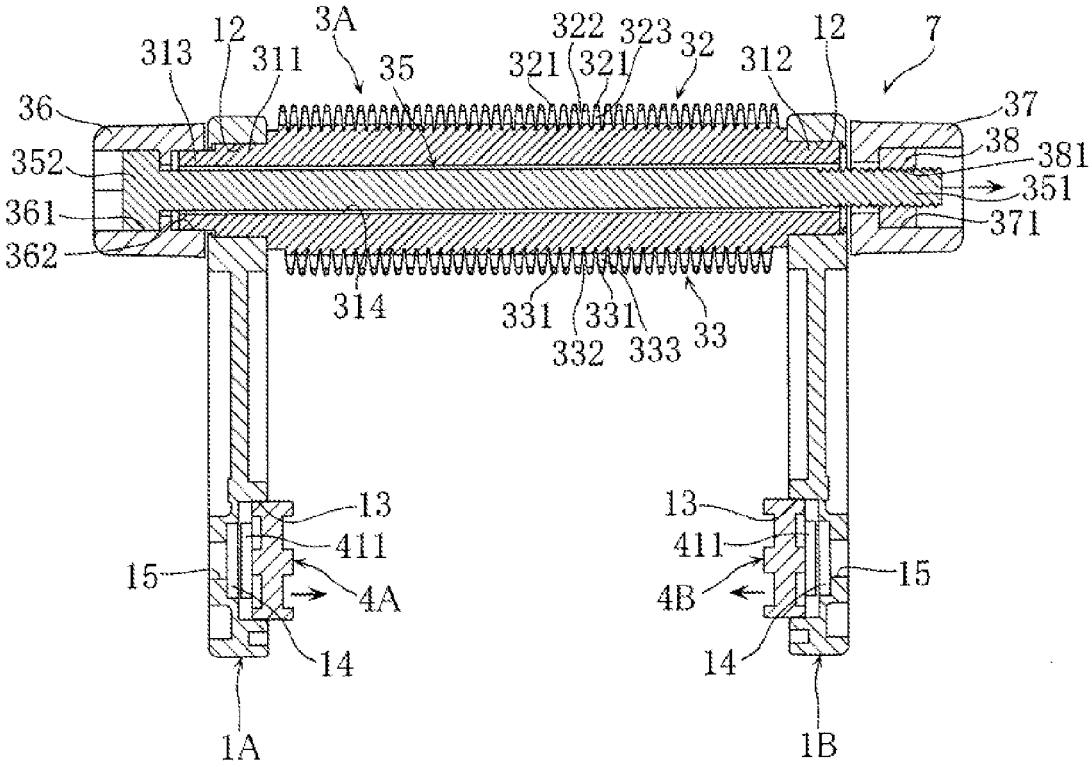
FIG. 14 is a sectional view for explaining an operation mechanism for a thread supporting shaft.

As shown in FIG. 6, an operational portion 37 is attached to the threaded shaft 351 of the shaft member 35. The operational portion 37 is formed with a recess 371. In this recess 371, a nut 38 having a threaded hole 381 is fitted. The threaded hole 381 meshes with the threaded shaft 351. According to this arrangement, when the operational portion 37 (and hence, the nut 38) is turned in the direction to tighten the threaded shaft 351, the distance between the operational portions 36 and 37 reduces. This prevents rotation of the thread supporting shaft 3A sandwiched between the operational portions 36 and 37 via the two back side plates 1A and 1B relative to the two back side plates 1A and 1B. On the other hand, when the operational portion 37 is turned in the direction to loosen the threaded shaft 351, the distance between the operational portions 36 and 37 increases as shown FIG. 14. Thus, rotation of the thread supporting shaft 3A relative to the two back side plates 1A and 1B is allowed.

The outer circumference of the thread supporting shaft 3A is provided with a plurality of (two or more) thread supporting portions for supporting warp threads at different positions in the circumferential direction of the thread supporting shaft 3A. Preferably, these thread supporting portions are equally spaced from each other in the circumferential direction of the thread supporting shaft 3A. In the illustrated example, two thread supporting portions 32 and 33 are provided on the thread supporting shaft 3A as equally spaced apart from each other in the circumferential direction (e.g. arranged on the opposite sides across the central axis of the shaft).

Figure 3:
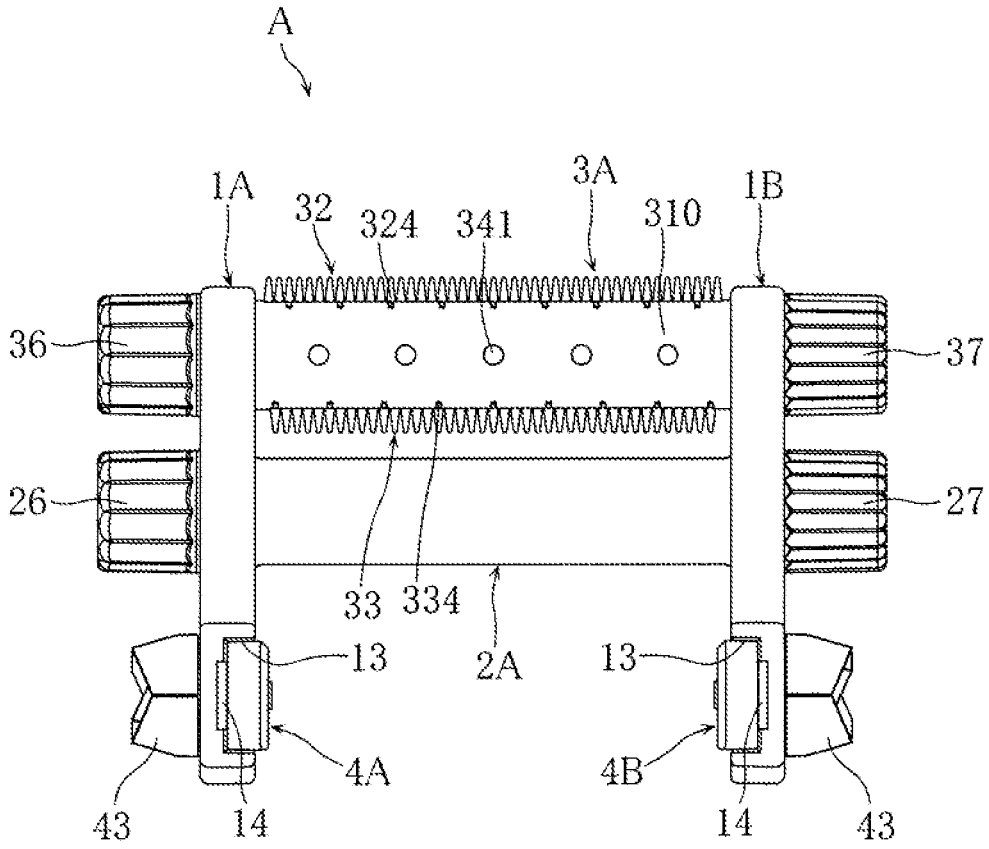
FIG. 3 is a front view of the beading loom.

As shown in FIGS. 1-3, the thread supporting shaft 3A has a cylindrical outer circumferential surface 310. The thread supporting portions 32 and 33 project radially outward from the outer circumferential surface 310. As shown in FIG. 6, the thread supporting portion 32 has a comb teeth-like shape having a plurality of projections 321 aligned in the axial direction of the thread supporting shaft 3A. A plurality of grooves 322 are formed between adjacent projections 321. The thread supporting portions 33 also has a comb teeth-like shape having a plurality of projections 331 aligned in the axial direction, and a plurality of grooves 332 are formed between adjacent projections 331. The grooves 322, 332 are aligned at predetermined pitches in the axial direction. The pitch P1 of the grooves 322 and the pitch P2 of the grooves 332 differ from each other. The pitches P1, P2 are set to the range of e.g. about 1-5 mm. The pitch P2 is larger than the pitch P1 in this embodiment.

As shown in FIG. 6, each groove 322, 332 is V-shaped in cross section. In the thread supporting portions 32 and 33, the projections 321 and 331 are formed with through-hole 323 and 333, respectively, penetrating the thread supporting shaft 3A in the axial direction. The through-holes 323 of the thread supporting portions 32 have a common center axis extending in the axial direction of the thread supporting shaft 3A, and the center axis crosses the grooves 322. Similarly, the through-holes 333 of the thread supporting portions 33 have a common center axis extending in the axial direction of the thread supporting shaft 3A, and the center axis crosses the grooves 332.

As shown in FIG. 3, the outer circumferential surface 310 of the thread supporting shaft 3A is provided with a plurality of scale marks 324 and 334 with respect to the thread supporting portions 32 and 33, respectively. The scale marks 324 and 334 are provided at regular intervals corresponding to the distance along a predetermined number of grooves 322 or 332.

Figure 10:
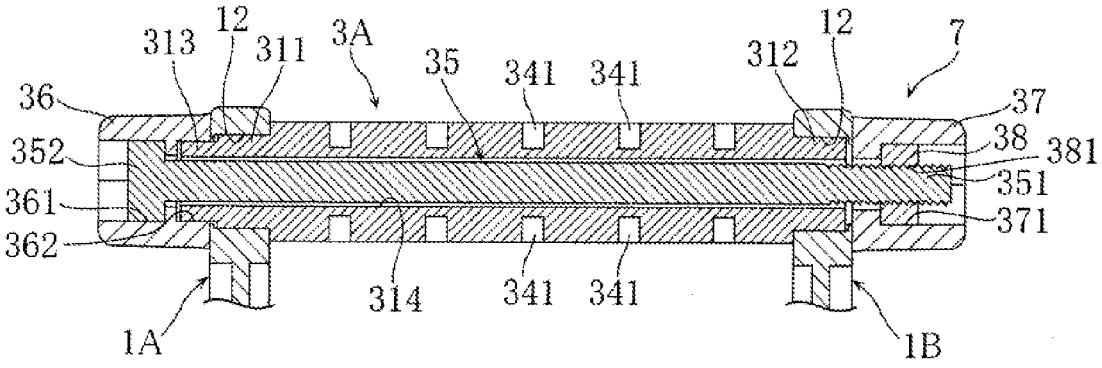
FIG. 10 is a sectional view taken along lines X-X in FIG. 6.

As shown in FIG. 10, the outer circumferential surface 310 of the thread supporting shaft 3A is formed with a plurality of attachment holes 311 for attaching a thread hook bar 34 (described later). In the illustrated example, the attachment holes 311 are divided into two groups positioned on the opposite sides across the central axis of the thread supporting shaft 3A. The attachment holes 341 in each of the groups are aligned in the axial direction in a region between the two thread supporting portions 32 and 33 (see FIG. 3).

The structure of the thread supporting shaft 3B (thread supporting portions 32, 33, scale marks 324, 334, attachment holes 311 and so on) is substantially the same as that of the thread supporting shaft 3A. In the thread supporting shaft 3B, the shaft end 313 extends to the outside from the right front side plate 1D, and the operational portion 36 is provided on the outside of the right front side plate 1D. The operational portion 37 having a threaded hole 301 meshing with the threaded shaft 351 is provided on the outside of the left front side plate 1C.

The thread supporting shafts 3A and 3B having the above-described structure are made of e.g. a synthetic resin such as polyacetal resin. For instance, each of the thread supporting shafts 3A and 3B can be made by integrally bonding two members divided in the radial direction.

The operation mechanism 7 is a mechanism for rotating the thread supporting shafts 3A and 3B and includes the above-described shaft members 35 and the operational portions 36 and 37.

The connecting structure that connects the connecting member 4A to the left back side plate 1A and the left front side plate 1C, and the connecting structure that connects the connecting member 4B to the right back side plate 1B and the right front side plate 1D are described below. Note that the connecting structure that connects the connecting member 4A to the left front side plate 1C and the connecting structure that connects the connecting member 4B to the right back side plate 1B and the right front side plate 1D are the same as the connecting structure that connects the connecting member 4A to the left back side plate 1A.

Figure 11:
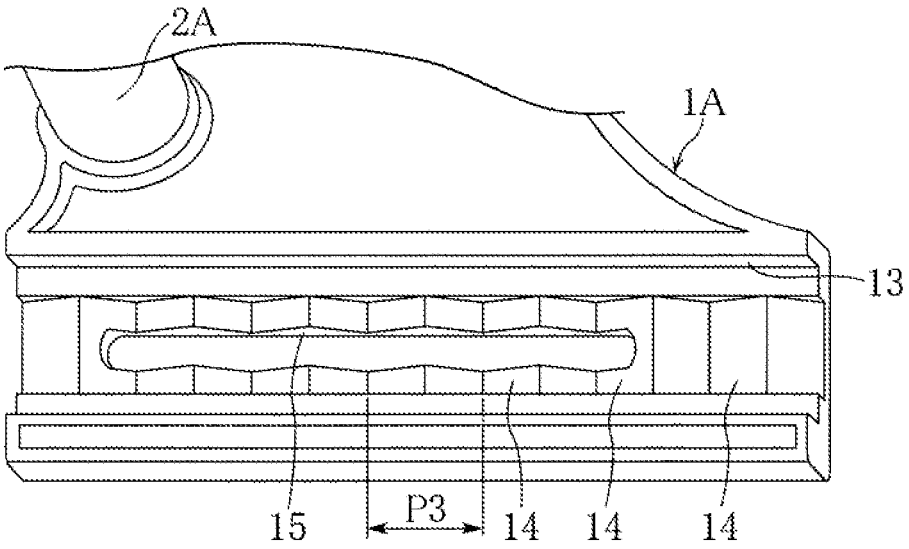
FIG. 11 is a perspective view showing the inner side of a left back side plate.

As shown in FIG. 11, the left back side plate 1A includes a guide groove 13, a plurality of grooves 14 and an elongated hole 15 (see also FIGS. 5 and 6). The guide groove 13 is provided on the inner side of the left back side plate 1A (on the right side of the side plate 1A in FIGS. 5 and 6) and elongated in the longitudinal direction. The grooves 14 are formed at the bottom of the guide groove 13 as connected to each other in the longitudinal direction. Each of the grooves 14 is V-shaped in cross section. The grooves 14 are aligned at a predetermined pitch P3 in the longitudinal direction. For instance, the pitch P3 of the grooves 14 is about 1 cm. The elongated hole 15 penetrates the side plate in the lateral direction, is elongated in the longitudinal direction and provided at a part of the region where the grooves 11 are formed.

As shown in FIGS. 1 and 2, the connecting member 4A is elongated in the longitudinal direction. The connecting member 4A is received in the guide groove 13 of the left back side plate 1A, and in this received state, movable relative to the left back side plate 1A in the longitudinal direction. On the outside of the connecting member 4A in the lateral direction are provided a plurality of protrusions 411 at a predetermined interval in the longitudinal direction (see FIG. 1). The protrusions 411 are V-shaped in cross section and can be fitted in the grooves 14 of the left back side plate 1A.

Figure 4:
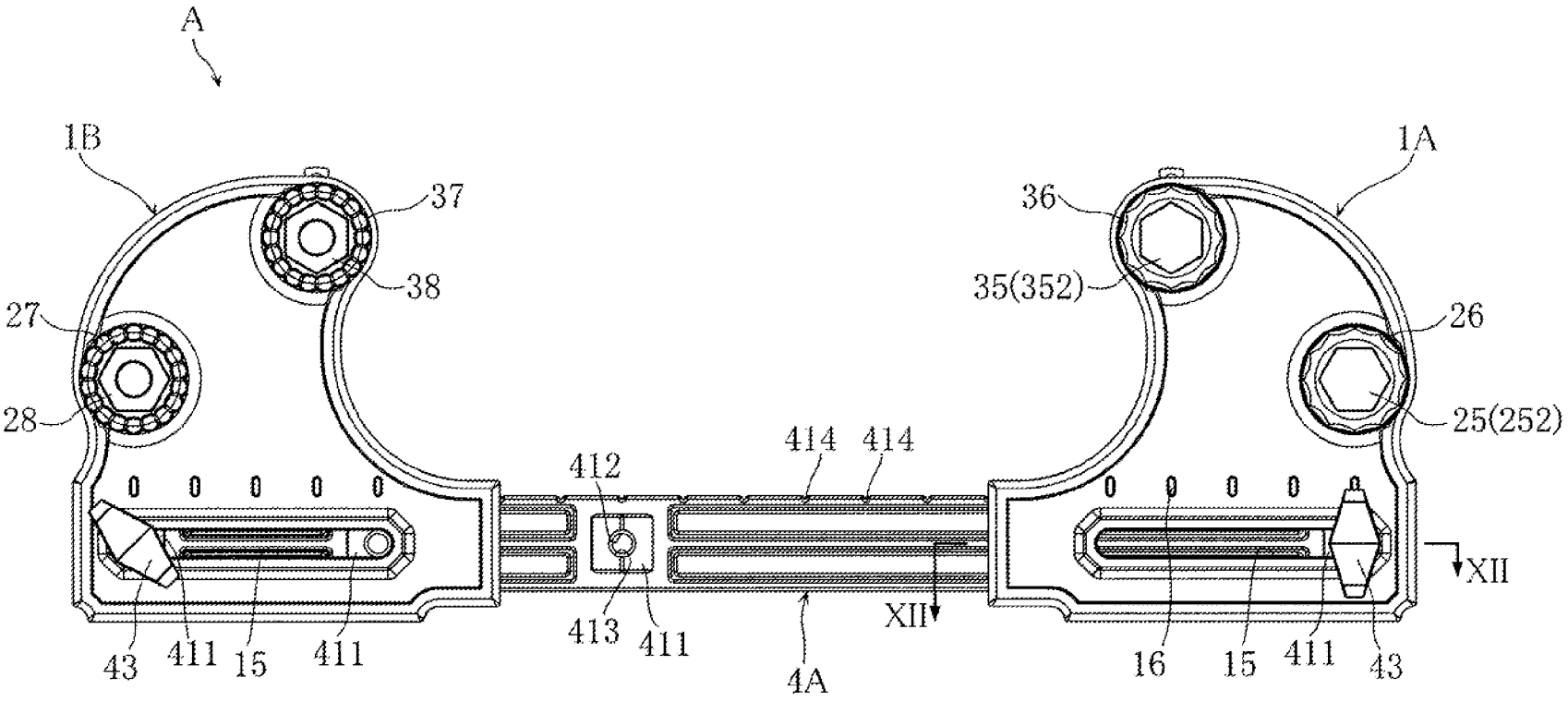
FIG. 4 is a left side view of the beading loom.
Figure 12:
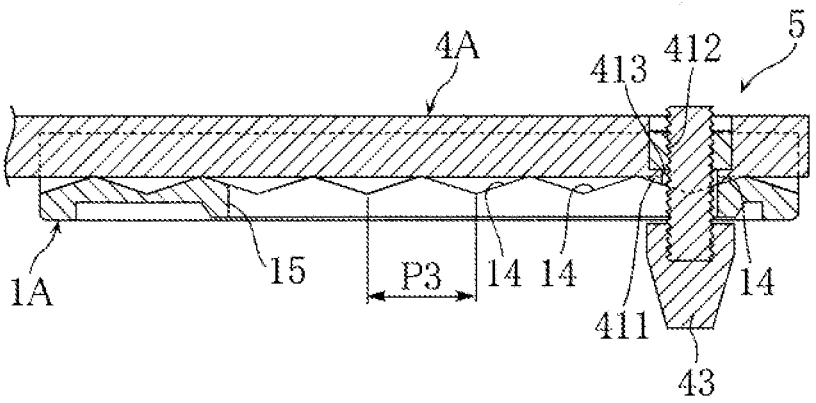
FIG. 12 is a sectional view taken along lines XII-XII in FIG. 4.

As shown in FIGS. 4 and 5, the connecting member 4A is provided with threaded holes 412 extending in the lateral direction at the positions of the protrusions 411. Specifically, the connecting member 4A is formed with a through-hole 413 penetrating in the lateral direction at the center of each protrusion 411. The threaded hole 412 is provided by fitting a member having a threaded hole (e.g. nut) from the inner side of the protrusion 411. FIGS. 5 and 12 show the state in which one of the threaded holes 412 faces the elongated hole 15. A clamp bolt 43 is screwed into the threaded hole 412 from the outside in the lateral direction through the elongated hole 15.

As shown in FIG. 4, the outer side surface of the left hack side plate 1A is provided with marks 16 at positions corresponding to the grooves 14. The marks 16 are aligned at the same pitch as the pitch P3 of the grooves 14.

As shown in FIGS. 1, 2 and 4, the upper surface of the connecting member 4A is formed with recesses as marked lines 414 located with reference to the protrusions 411. The marked lines 414 are aligned at the same pitch as the pitch P3 of the grooves 14.

Figure 13:
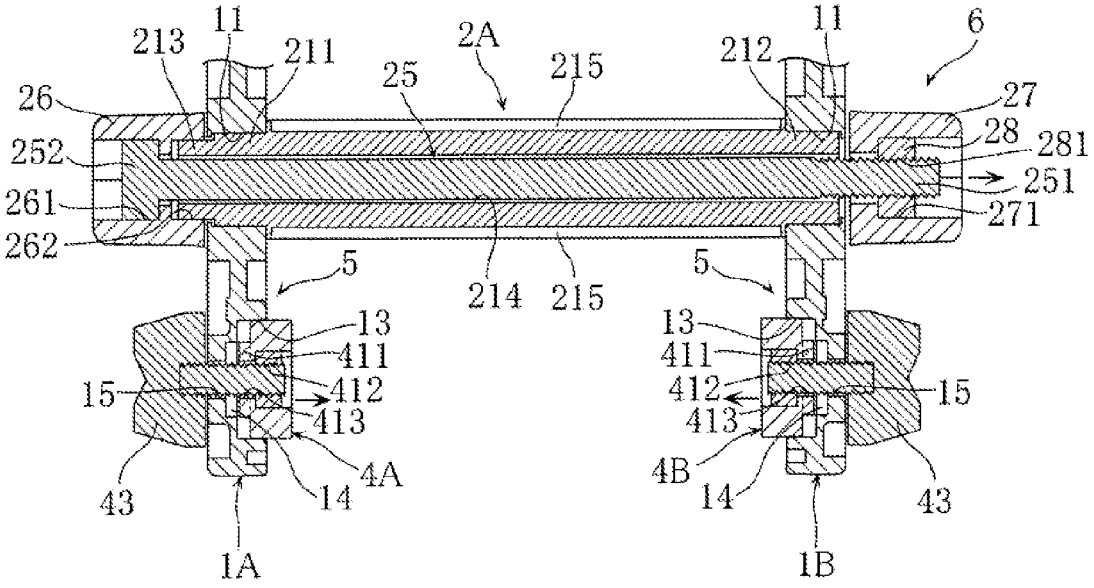
FIG. 13 is a sectional view for explaining an operation mechanism for a thread fixing shaft.
Figure 15:
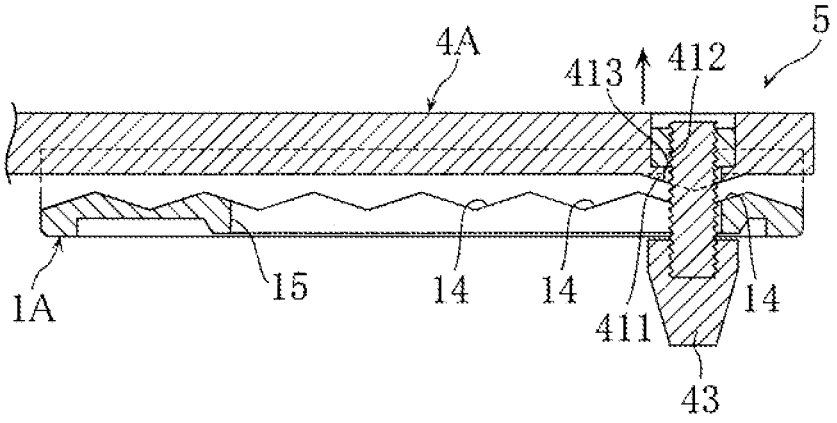
FIG. 15 is a sectional view for explaining a length adjustment mechanism.

In the above-described structure, when the clamp bolt 43 is loosened, the connecting member 4A moves inward in the lateral direction relative to the left back side plate 1A. As shown in FIGS. 13 and 15, the protrusion 411 of the connecting member 4A and the groove 14 of the left back side plate 1A are disengaged from each other, so that the left back side plate 1A becomes movable relative to the connecting member 4A in the longitudinal direction. As will be understood from FIG. 15, the left back side plate 1A is movable within the range of the length of the elongated hole 15.

On the other hand, when the clamp bolt 43 is tightened, the protrusion 411 fits into the groove 14, so that movement of the connecting member 4A relative to the left back side plate 1A is inhibited. Since the grooves 14 are aligned at the predetermined pitch P3 in the longitudinal direction, by fitting the protrusion 411 into each groove 14, the position of the connecting member 4A relative to the left back side plate 1A can be changed stepwise by the pitch P3. Accordingly, as will be understood from FIGS. 2 and 15, the length from the rear end of the left front side plate 1C to the front end of the left back side plate 1A can be adjusted stepwise.

Similarly to the left back side plate 1A, each of the left front side plate 1C, the right back side plate 1B and the right front side plate 1D is provided with the guide groove 13, grooves 14, the elongated hole 15 and marks 16.

As shown in FIG. 4, the connecting member 4A is provided with three protrusions 411 in a region closer to the front end at a predetermined pitch in the longitudinal direction. Each of these protrusions 411 is used for connection to the left front side plate 1C, and whichever protrusion 411 is used, the position of the connecting member 4A relative to the left front side plate 1C can be changed stepwise by the pitch P3. Moreover, by using a plurality of protrusions 411 in this way, the position of the connecting member 4A relative to the left front side plate 1C can be changed over a wider range than when a single protrusion is used.

Similarly to the connecting member 4A, the connecting member 4B includes the protrusions 411, threaded hole 412 and the hole 413.

As will be understood from the above-described structure, the positions of the two connecting members 4A, 4B relative to the two back side plates 1A, 1B can be changed stepwise by the pitch P3. Also, the positions of the two connecting members 4A, 4B relative to the two front side plates 1C, 1D can be changed stepwise by the pitch P3. That is, the length from the rear ends of the two front side plates 1C, 1D to the frond ends of the two back side plates 1A, 1B can be adjusted stepwise.

The protrusions 411 and the threaded hole 412 provided in each connecting member 4A, 4B and the grooves 14 and the elongated hole 15 provided in each side plate 1A, 1B, 1C, 1D constitute the length adjustment mechanism 5.

An example of beading operation using the beading loom A is described below with reference to FIGS. 16-18. In this operation, a relatively short beaded fabric is made. In the case explained below, of the two thread supporting portions 32 and 33, the thread supporting portions 32 (groove pitch: P1) is used. However, similar operation is performed when the thread supporting portions 33 (groove pitch: P2) is used.

First, thread hook bars 34 are attached to the attachment holes 341 of the thread supporting shafts 3B and 3A. In the example shown in FIG. 16, three thread hook bars (left, center and right thread hook bars) are attached.

Then, one end of a thread is fastened to e.g. the right thread hook bar 34 of the thread supporting shaft 3B. Then, the thread is fitted in one groove 322 ("first groove") of each thread supporting shaft 3B, 3A while being longitudinally extended. Then, the thread is hooked around the right thread hook bar 34 of the thread supporting shaft 3A. Then, the thread is fitted into the groove 322 ("second groove") on the immediate left of the first groove 322 while being extended. Then, the thread is hooked around the right thread hook bar 34 of the thread supporting shaft 3B. Then, the thread is fitted into the groove 322 on the immediate left of the second groove while being extended. After this operation is repeated a predetermined number of times with respect to the right thread hook bars 34 of the thread supporting shaft 3B and 3A, the same operation is performed with respect to the center thread hook bars 34 and the left hook bars 34. Finally, the terminal of the warp thread T1 is fastened to e.g. the left thread hook bar 34 of the thread supporting shaft 3A. In this way, as shown in FIG. 16, a plurality of warp threads T1 are supported by the thread supporting shafts 3B and 3A as equally spaced from each other in the lateral direction.

Figure 17:
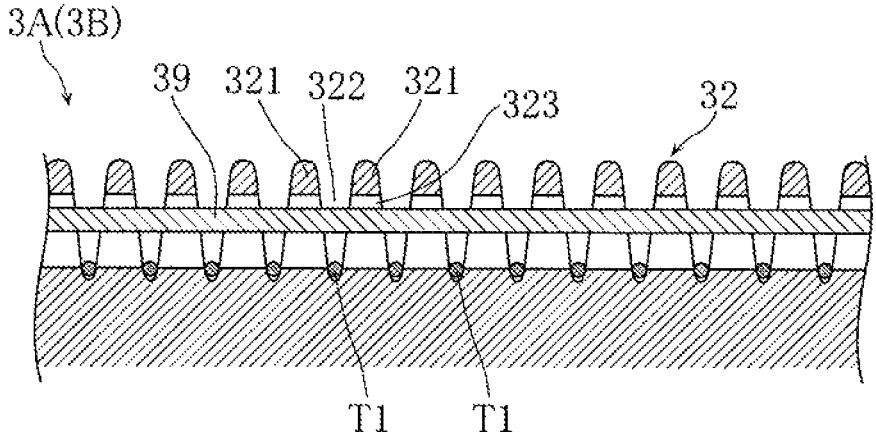
FIG. 17 is a sectional view for explaining how to use the beading loom.

Then as shown in FIG. 17, a bar-shaped stopper 33 is inserted through all the through-holes 323 of the thread supporting portion 32.

Figure 18A:
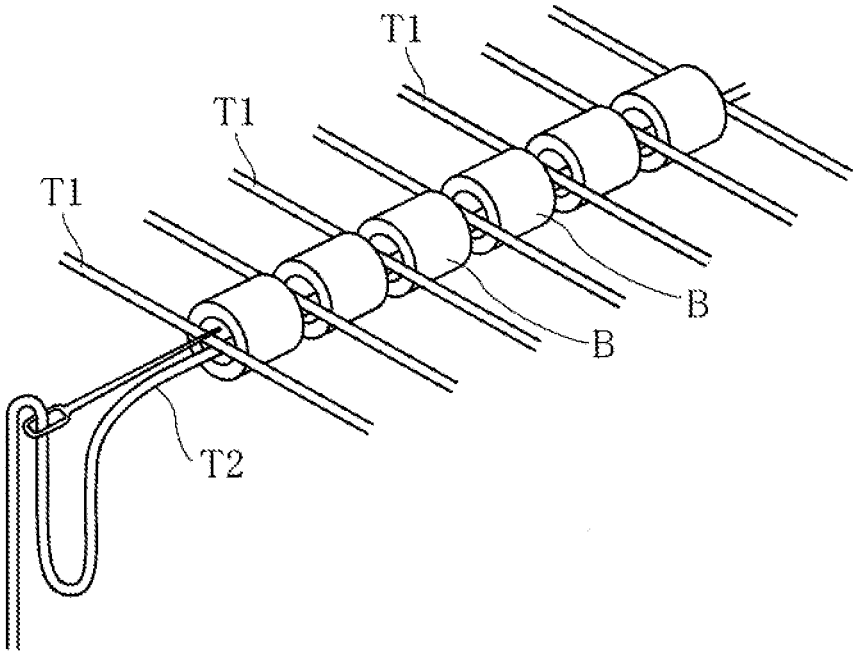
FIGS. 18A and 18B are perspective views for explaining a beading process.
Figure 18B:
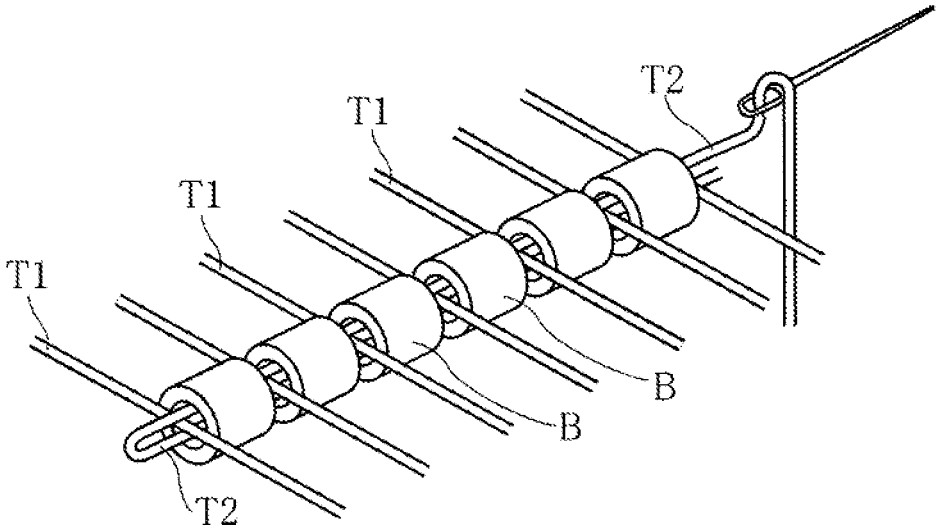

Then, a weft thread on which a plurality of beads are strung is woven in the warp threads. Specifically, as shown in FIG. 18A, the weft thread T2 is lifted from under the warp threads T1 so as to cross the warp threads T1, so that each bead B is sandwiched between adjacent warp threads T1. Then, as shown in FIG. 18B, the weft thread T2 is turned back adjacent to the leftmost warp thread T1 and passed back through the beads B so that the weft thread T2 passes over the warp threads T1. In this way, the weft thread T2 is passed through the beads B twice so that the warp threads T1 are sanded from above and below by the weft thread T2. Then, after a plurality of beads are strung on the weft thread T2, the weft thread T2 is turned back adjacent to the rightmost warp thread T1. Then, the weft thread T2 is lifted from under the warp threads T1 so as to cross the warp threads T1, so that each bead B is sandwiched between adjacent warp threads T1. Then, the weft thread T2 is passed back through the beads B so that the weft thread T2 passes over the warp threads T1.

By repeating this operation, a beaded fabric having a predetermined length in the direction in which the warp threads T1 extend (longitudinal direction) is made.

Then, after the stopper 35 is pulled out of the through-holes 323, the warp threads T1 are detached from the thread hook bars 34 by slightly turning the thread supporting shafts 3B and 3A. In this way, the beaded fabric is detached from the beading loom A. Then, by pulling the opposite ends of the warp threads T1, slack (e.g. the portions that have been hooked around the thread hook bars) is removed, whereby the work is completed.

Figure 19:
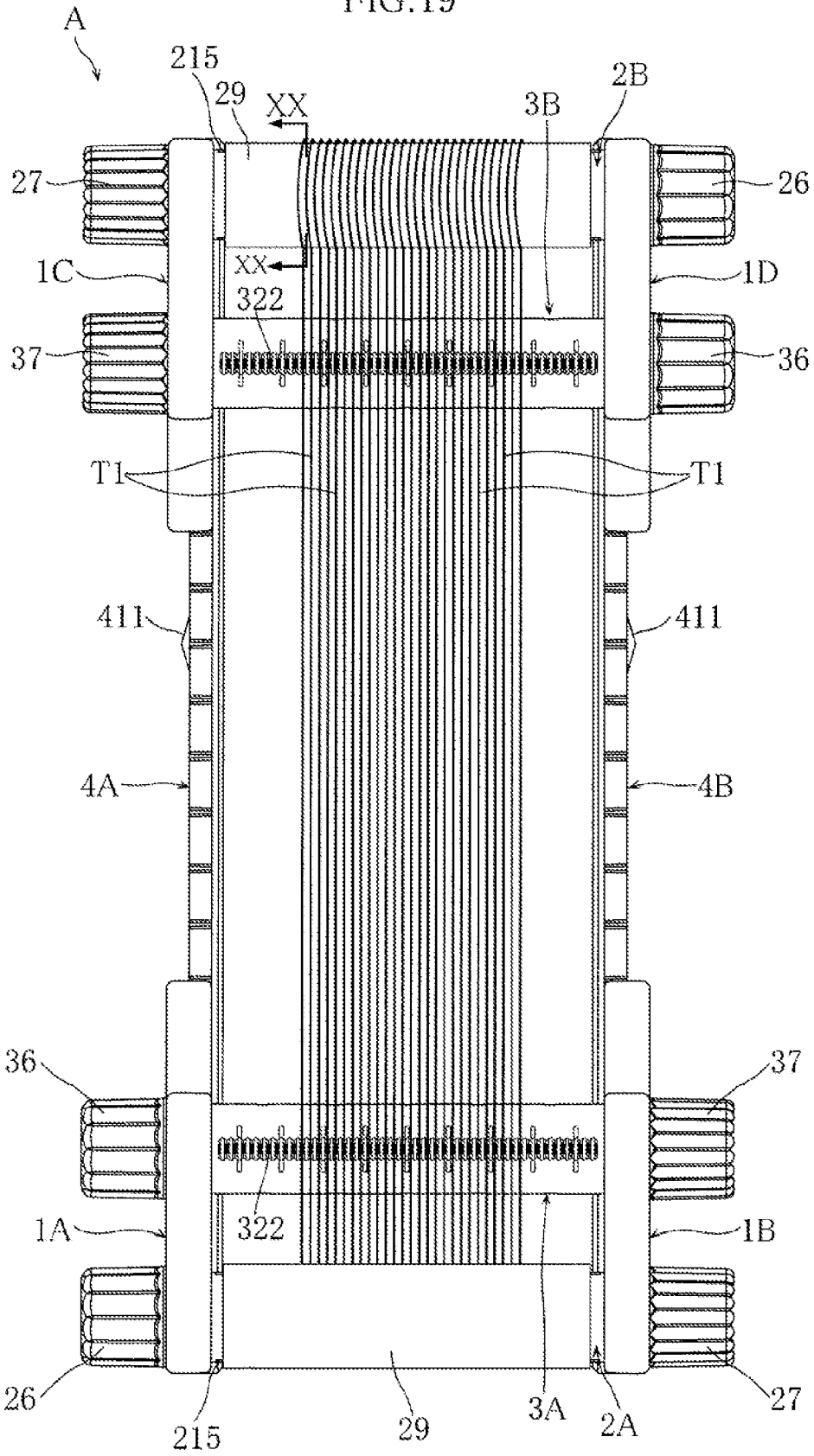
FIG. 19 is a plan view for explaining how to use the beading loom.
Figure 20:
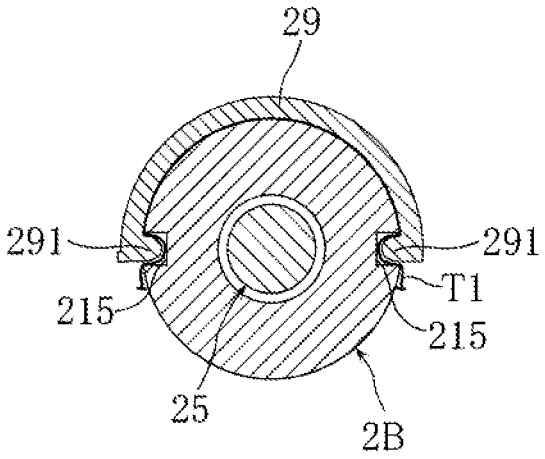
FIG. 20 is a sectional view taken along lines XX-XX in FIG. 19.

The operation to make a relatively long beaded fabric is described below with reference to FIGS. 19 and 20. Also in the case explained below, of the two thread supporting portions 32 and 33, the thread supporting portions 32 (groove pitch: P1) is used. However, similar operation is performed when the thread supporting portions 33 (groove pitch: P2) is used.

First respective first ends of a plurality of warp threads T1 are fastened to the thread fixing shaft 2B. Specifically, each warp thread T1 is placed to bridge between the paired recesses 215 of the thread fixing shaft 2B, and in this state, a thread fixing member 29 is attached to the thread fixing shaft 2B. As shown in FIG. 20, the thread fixing member 29 is semicircular in cross section and extends uniformly along the axial direction of the thread fixing shaft 2B. The opposite edges of the thread fixing member 29 are provided with a pair of engagement portions 291 bulging toward each other. Attachment of the thread fixing member 29 is performed by elastically deforming the thread fixing member 29 so as to increase the dimension between the engagement portions 291 and then bringing the engagement portions 291 into engagement with the recesses 215. By attaching the thread fixing member 29, the warp threads T1 are sandwiched between the thread fixing shaft 2B and the thread fixing member 29 and hence fixed. Then, the thread fixing shaft 2B is rotated to wind up the warp threads by a predetermined length. Then, the warp threads T1 are fitted into the grooves 322 of the thread supporting shafts 3B and 3A while being extended toward thread fixing shaft 2A. Then, the terminals of the warp threads T1 are fastened to the thread fixing shaft 2A. Specifically, the warp threads T1 are fastened to the thread fixing shaft 2A in a manner similar to the fastening of the warp threads T1 to the thread fixing shaft 2B. In this way, as shown in FIG. 19, a plurality of warp threads T1 are supported by the thread supporting shafts 3B, 3A as equally spaced from each other in the lateral direction.

Then, as shown in FIG. 17, a bar-shaped stopper 29 is inserted through all the through-holes 323 of the thread supporting portion 32.

Then, weaving of a weft thread on which beads are strung is performed. This weaving operation is performed similarly to the weaving described with reference to FIG. 18. By performing the weaving of the weft thread, a woven portion is made between the thread supporting shafts 3B and 3A. Then, by paying out the warp threads by rotating the thread fixing shaft 2B, the thread fixing shaft 2A is rotated to wind the woven portion onto the thread fixing shaft 2A. Then, the weft thread is woven with the warp thread newly paid out. By repeating this operation, a long beaded fabric is made.

Advantages of the beading loom A are described below.

In the beading loom A, each of the thread supporting shafts 3B and 3A is formed with a plurality of thread supporting portions 32 and 33 at different positions in the circumferential direction. The thread supporting portion 32 has a plurality of grooves 322 arranged at a predetermined pitch P1 in the axial direction, whereas the thread supporting portion 33 has a plurality of grooves 332 arranged at a predetermined pitch P2 in the axial direction. The pitch P1 of the grooves 322 and the pitch P2 of the grooves 332 differ from each other, and the pitch P1 is smaller than the pitch P2 According to this arrangement, to make a beaded fabric, the grooves 322 or the grooves 332 that have the pitch corresponding to the length of the beads B can be appropriately selected for use.

When relatively short beads B are used, as described with reference to FIG. 16 or FIG. 19, weaving is performed with the grooves 322 having the pitch P1 arranged on the upper side. On the other hand, when relatively long beads B are used, weaving is performed with the grooves 332 having the pitch P2 arranged on the upper side. The distance between adjacent warp threads T1 to be fitted in the grooves 322 (332) corresponds to the pitch P1 (P2) of the grooves 322 (332). Thus, by using either of the grooves 322 and the grooves 332 that correspond to the length of the beads B, each bead B can be held as sandwiched between adjacent warp threads T1, so that the weaving operation can be performed efficiently.

The grooves 322 and 332 having different pitches P1 and P2 are provided at each of the thread supporting shafts 3B and 3A. By appropriately rotating the thread supporting shafts 3B and 3A, switching between the grooves 322 and the grooves 332 can be easily performed.

Each of the grooves 322, 332 is V-shaped in cross section. Thus, as shown in FIG. 17, the warp threads T1 fitted in the bottom of the grooves 322 are prevented from moving to the sides. Thus, the distance between adjacent ones of the warp threads T1 is kept uniform.

The thread supporting portions 32 and 33 project radially outward from the outer circumferential surfaces 310 of the thread supporting shafts 3B and 1A. According to this arrangement, by using the thread supporting portions 32 (33) as arranged on the upper side of the thread supporting shafts 3B and 3A, the warp threads T1 fitted in the grooves 322 (332) are prevented from coming into contact with the outer circumferential surfaces 310 of the thread supporting shafts 3B and 3A. As a result, the warp threads T1 are held at the bottom of the grooves 322 (332) so as not to move to the sides.

As described with reference to FIG. 17, in performing the beading operation, the stopper 39 can be inserted into the through-holes 323 (333) formed in the thread supporting portions 32 (33). In making a relatively long beaded fabric, the warp thread T1 slacks between the supporting shafts 3B and 3A when the warp thread T1 is paid out by rotating the thread fixing shaft 2B, whereby the warp thread T1 may become as if it is pushed upward. Even in such a case, as will be understood from FIG. 17, the stopper 39 prevents the warp thread T1 from rising. Thus, the warp thread T1 does not slip off the grooves 322 (332).

Figure 16:
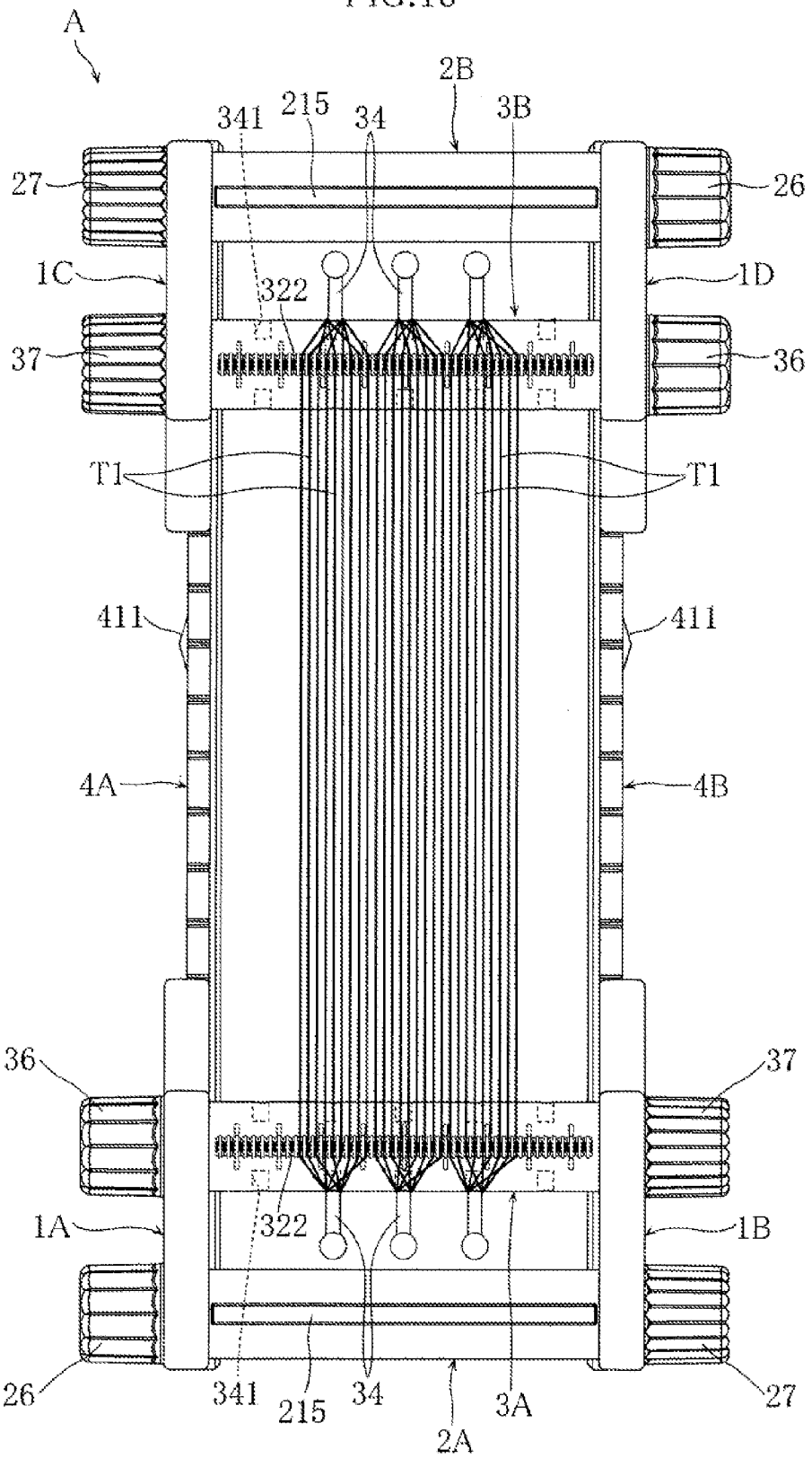
FIG. 16 is a plan view for explaining how to use the beading loom.

As shown in FIG. 16, the thread hook bars 34 for hooking the warp threads T1 are provided at the thread supporting shafts 3B and 3A. According to this arrangement, the thread supporting portions 32 and the thread hook bars 34 are arranged close to each other, so that the length of the thread extended between the thread supporting portions 32 and the thread hook bars 34 can be shortened. Moreover, a plurality of thread hook bars 34 are arranged as spaced apart from each other in the axial direction of the thread supporting shafts 3B and 3A. This allows the thread to be hooked around one of the thread hook bars 34 that is closest from the thread supporting portions 32. This leads to reduction of the length of the thread to be used.

The thread hook bars 34 can be removably attached to either of the two regions positioned between the two thread supporting portions 32 and 33 (see the attachment holes 341 shown in FIGS. 10 and 16). Thus, the thread hook bars 34 can be attached to appropriate positions in accordance with the thread supporting portion 32 or the thread supporting portion 33 selected to be used for head weaving.

In this embodiment, the operation mechanisms 7 for rotating the thread supporting shafts 3A and 3B are provided. As described with reference to e.g. FIGS. 2 and 6, the operation mechanism 7 includes the threaded shaft 351 that rotates with the thread supporting shaft 3A (3B), the operational portion 36 that rotates with the thread supporting shaft 3A (3B), and the operational portion 37 having the threaded hole 381 that meshes with the threaded shaft 351. The threaded shaft 351 projects to the outside of the right back side plate 1A (left front side plate 1C) at a first end of the thread supporting shaft 3A (3B) in the axial direction. The operational portion 36 is provided on the outside of the left back side plate 1B (right front side plate 1C) at a second end of the thread supporting shaft 3A (3B) in the axial direction. The operational portion 37 is provided on the outside of the right back side plate 1B (left front side plate 1C) at the first end of the thread supporting shaft 3A (3B) in the axial direction. With this arrangement, when the operational portion 37 is rotated in the direction to loosen the threaded shaft 351 from the state where the thread supporting shaft 3A (3B) is fixed, the distance between the operational portions 36 and 37 increases, whereby the thread supporting shaft 3A becomes rotatable, as described with reference to FIG. 14. In this state, when the operational portion 36 is rotated, the thread supporting shaft 3A (3B) rotates together. That is, the thread supporting shaft 3A (3B) can be rotated via the operational portion 36 without touching the shaft.

According to the beading loom A of this embodiment, the length from the rear ends of the two front side plates 1C and 1D to the front ends of the two back side plates 1A and 1B (and hence, the distance between the thread supporting shaft 3B and the thread supporting shaft 3A) can be adjusted stepwise by the predetermined pitch P3 by the length adjustment mechanism 5. With this arrangement, the distance between the thread supporting shaft 3B and the thread supporting shaft 3A can be easily adjusted so as to be equal on the opposite sides in the lateral direction. As a result, uniform tension is applied to the warp threads T1 supported in parallel to each other by the thread supporting shafts 3B and 3A. This enhances the quality of the beaded fabric.

When a plurality of beaded fabrics which differ from each other in overall length are to be made, the length between the thread supporting shafts 3B and 3A can be adjusted stepwise by the pitch P3 depending on the overall length of each fabric.

The stepwise length adjustment can be performed by fitting each protrusion 411 into a selected one of the grooves 14 aligned at the predetermined pitch P3 in the longitudinal direction. According to this arrangement, the stepwise change of the positions of the connecting members 4A and 4B relative to the two back side plates 1A and 1B (two front side plates 1C and 1D) can be performed properly.

The grooves 14 formed in the two back side plates 1A and 1B (two front side plates 1C and 1D) are V-shaped in cross section and connected to each other in the longitudinal direction. Each of the protrusions 411 formed in the connecting members 4A and 4B has a V-shaped cross section to be fitted to (e.g. to come into close contact with) the grooves 14. According to this arrangement, even when the protrusion 411 is at first slightly deviated in the longitudinal direction from the groove 14 to be fitted, the two members are properly guided in the fitting process and finally fitted to each other at a proper position.

The operation to fit the protrusion 411 into the groove 14 is performed by screwing the clamp bolt 43 into the threaded hole 412 facing the elongated hole 15 (see FIG. 4). According to this arrangement, it is possible to easily switch between the state where the protrusion 411 and the groove 14 are fitted to each other and the state where they are released from the fitted state, only by the operation of the clamp bolt 43.

The elongated hole 15 is provided in the region were a plurality of grooves 14 are formed, and the threaded hole 412 is provided in the region where the protrusion 411 is formed. With this arrangement, in tightening the clamp bolt 43, the axial force of the screw portion acts efficiently due to the fitting of the protrusion 411 and the groove 14. This arrangement is advantageous for reliably fitting the protrusion 411 and the groove 14 to each other.

The outer sides of the two back side plates 1A and 1B (two front side plates 1C and 1D) in the lateral direction are provided with marks 16 at positions corresponding to the grooves 14. When the clamp bolt 43 is aligned with one of the marks 16, the corresponding groove 11 and the protrusion 411 face each other. Thus, the stepwise length adjustment can be performed easily.

The beading loom A of this embodiment includes the operation mechanism 6 for rotating the thread fixing shafts 2A and 2B. As described with reference to e.g. FIGS. 2 and 5, the operation mechanism 6 includes the threaded shaft 251 that rotates with the thread fixing shaft 2A (2B), the operational portion 26 that rotates with the thread fixing shaft 2A (2B), and the operational portion 27 having the threaded hole 281 that meshes with the threaded shaft 251. The threaded shaft 251 projects to the outside of the right back side plate 1B (left front side plate 1C) at a first end of the thread fixing shaft 2A (2B) in the axial direction. The operational portion 26 is provided on the outside of the left back side plate 1A (right front side plate 1D) at a second end of the thread fixing shaft 2A (2B) in the axial direction. The operational portion 27 is provided on the outside of the right, back side plate 1B (left front side plate 1C) at the first end of the thread fixing shaft 2A (2B) in the axial direction. With this arrangement, when the operational portion. 27 is rotated in the direction to loosen the threaded shaft 251 from the state where the thread fixing shaft 2A (2B) is fixed, the distance between the operational portions 26 and 27 increases, whereby the thread fixing shaft 2A becomes rotatable, as described with reference to FIG. 13. In this state, when the operational portion 26 is rotated, the thread fixing shaft 2A (2B) rotates together with the operational portion 26.

The threaded shaft 251 is provided at one end of the shaft member 25. At the other end of the shaft member 25 is provided the operational portion 26. The shaft member 25 is received in the shaft hole 214 of the thread fixing shaft 2A (2B) and rotates with the thread fixing shaft 2A (2B). That is, the shaft member 25 is unrotatable relative to the thread fixing shaft 2A (2B). As will be understood from e.g. FIGS. 5 and 13, the opposite ends of the thread fixing shaft 2A (2B) in the axial direction are connected to the two back side plates 1A and 1B (two front side plates 1C and 1D). This structure can be assembled by inserting the shaft member 25 provided with the operational portion 26 into the shaft hole 214. In this way, the intervention of the shaft member 25 makes the thread fixing shaft 2A (2B), the threaded shaft 251 and the operational portion 26 unrotatable relative to each other, while facilitating the assembling.

As described with reference to e.g. FIG. 5, the shaft end 213 of the thread fixing shaft 2A (2B), which is polygonal in cross section, is fitted in the recess 262 of the operational portion 26, and the end portion 252 of the shaft member 25, which is polygonal in cross section, is fitted in the recess 261 of the operational portion 26. This arrangement reliably make the thread fixing shaft 2A (2B) the shaft member 25, and the operational portion 26 unrotatable relative to each other.

The beading loom A of this embodiment is provided with the operation mechanism 7 for rotating the thread supporting shafts 3A and 3B. As described with reference to e.g. FIGS. 2 and 6, the operation mechanism 7 includes the threaded shaft 351 that rotates with the thread supporting shaft 3A (3B), the operational portion 36 that rotates with the thread supporting shaft 3A (3B), and the operational portion 37 having the threaded hole 381 that meshes with the threaded shaft 351. The threaded shaft 351 projects to the outside of the right back side plate 1B (left front side plate 1C) at a first end of the thread supporting shaft 3A (3B) in the axial direction. The operational portion 36 is provided on the outside of the left back side plate 1A (right front side plate 1D) at a second end of the thread supporting shaft 3A (3B) in the axial direction. The operational portion 37 is provided on the outside of the right back side plate 1B (left front side plate 1C) at the first end of the thread supporting shaft 3A (3B) in the axial direction. With this arrangement, when the operational portion 37 is rotated in the direction to loosen the threaded shaft 351 from the state where the thread supporting shaft 3A (3B) is fixed, the distance between the operational portions 36 and 37 increases, whereby the thread supporting shaft 3A (3B) becomes rotatable, as described with reference to FIG. 14. In this state, when the operational portion 36 is rotated, the thread supporting shaft 3A (3B) rotates together with the operational portion 36. That is, the thread supporting shaft 3A (3B) can be reliably rotated just by the rotation of the operational portion 36 without touching the thread supporting shaft 3A (3B).

The threaded shaft 351 is provided at one end of the shaft member 35. At the other end of the shaft member 35 is provided the operational portion 36. The shaft member 35 is received in the shaft hole 314 of the thread supporting shaft 3A (3B) and rotates with the thread supporting shaft 3A (3B). As will be understood from FIGS. 6 and 14, this structure can be assembled by inserting the shaft member 35 provided with the operational portion 36 into the shaft hole 314, with the opposite ends of the thread supporting shaft 3A (3B) in the axial direction connected to the two back side plates 1A and 1B (two front side plates 1C and 1D). In this way, the intervention of the shaft member 35 makes the thread supporting shaft 3A (35), the threaded shaft 351 and the operational portion 36 unrotatable relative to each other, while facilitating the assembling.

As described with reference to e.g. FIG. 6, the shaft end 313 of the thread supporting shaft 3A (3B), which is polygonal in cross section, is fitted in the recess 362 of the operational portion 36, and the end portion 352 of the shaft member 35, which is polygonal in cross section, is fitted in the recess 361 of the operational portion 36. This arrangement reliably makes the thread supporting shaft 3A (3B), the shaft member 35, and the operational portion 36 unrotatable relative to each other.

Though the present invention has been described based on an embodiment, the present invention is not limited to the embodiment and can be varied in various ways without departing from the spirit of the invention.

For instance, while the grooves 14 and the protrusions 411 are V-shaped in cross section in the embodiment, the present invention is not limited to this, and any shape may be employed as long as the protrusions 411 are fitted in the grooves 14. For instance, the grooves 14 and protrusions 411 may have curved surfaces such as spherical surfaces. In the embodiment, grooves 14 are provided in the side plates 1A-1D, while protrusions 411 are provided in the connecting members 4A, 4B. The present invention is not limited to this, and the grooves 14 may be provided in the connecting members 4A, 4B, whereas the protrusions 411 may be provided in the side plates 1A-1D.

The invention claimed is:

1. A beading loom comprising:

a first side support structure and a second side support structure spaced apart from each other in a lateral direction;

a first thread fixing shaft for fixing one end of each of a plurality of threads, the first thread fixing shaft being rotatably connected to the first side support structure and the second side support structure;

a second thread fixing shaft for fixing the other end of each of the threads, the second thread fixing shaft being spaced apart from the first thread fixing shaft in a longitudinal direction perpendicular to the lateral direction and rotatably connected to the first side support structure and the second side support structure;

a first thread supporting shaft provided adjacent to the first thread fixing shaft to hold the threads as spaced apart from each other in the lateral direction, the first thread supporting shaft being positioned between the first thread fixing shaft and the second thread fixing shaft as viewed in a height direction perpendicular to both of the lateral direction and the longitudinal direction and rotatably connected to the first side support structure and the second side support structure; and a second thread supporting shaft provided adjacent to the second thread fixing shaft to hold the threads as spaced apart from each other in the lateral direction, the second thread supporting shaft being positioned between the first thread fixing shaft and the second thread fixing shaft as viewed in the height direction and rotatably connected to the first side support structure and the second side support structure;

wherein each of the first and second thread supporting shafts includes a first and a second thread supporting portions elongated in the lateral direction, the first and the second thread supporting portions being provided at different positions in a circumferential direction of the thread supporting shaft, each of the first and the second thread supporting portions including a plurality of grooves arranged at a predetermined pitch in the lateral direction, and the pitch of the grooves of the first thread supporting portion differs from the pitch of the grooves of the second thread supporting portion.

2. The beading loom according to claim 1, wherein each of the grooves of the first thread supporting portion and the grooves of the second thread supporting portion has a V-shaped cross section.

3. The beading loom according to claim 2, wherein each of the first and the second thread supporting shafts has a cylindrical outer circumferential surface, and each of the first and the second thread supporting portions of each of the thread supporting shafts projects radially outward from the outer circumferential surface of the thread supporting shaft.

4. The beading loom according to claim 3, wherein each of the first and the second thread supporting portions of each of the thread supporting shafts is formed with a plurality of through-holes having a common axis extending in the lateral direction.

5. The beading loom according to claim 1, further comprising a first thread hook bar to be removably attached to the first thread supporting shaft and a second thread hook bar to be removably attached to the second thread supporting shaft.

6. The beading loom according to claim 5, wherein the first thread hook bar is provided between the first thread supporting portion and the second thread supporting portion in the circumferential direction of the first thread supporting shaft.

7. The beading loom according to claim 1, further comprising an operation mechanism provided at each of the first and the second thread supporting shafts, wherein each of the thread supporting shafts includes a first end and a second end spaced apart from each other, the operation mechanism of each of the thread supporting shafts includes a threaded shaft which is provided at the first end and which rotates with the thread supporting shaft, a first operational portion which is provided at the second end and which rotates with the thread supporting shaft, and a second operational portion including a threaded hole meshing with the threaded shaft, and the first side support structure and the second side support structure are provided between the first operational portion and the second operational portion.

8. A beading loom comprising:

a first side plate and a second side plate spaced apart from each other in a lateral direction;

a third side plate and a fourth side plate spaced apart from the first side plate and the second side plate, respectively, in a longitudinal direction perpendicular to the lateral direction;

a first thread fixing shaft for fixing one end of each of a plurality of threads, the first thread fixing shaft being connected to the first side plate and the second side plate;

a second thread fixing shaft for fixing the other end of each of the threads, the second thread fixing shaft being connected to the third side plate and the fourth side plate;

a first thread supporting shaft for holding the threads as spaced apart from each other in the lateral direction, the first thread supporting shaft being connected to the first side plate and the second side plate at a position adjacent to the first thread fixing shaft;

a second thread supporting shaft for holding the threads as spaced apart from each other in the lateral direction, the second thread supporting shaft being connected to the third side plate and the fourth side plate at a position adjacent to the second thread fixing shaft;

a first connecting member connecting the first side plate and the third side plate to each other;

a second connecting member connecting the second side plate and the fourth side plate to each other; and a length adjustment mechanism for changing a distance between the first thread supporting shaft and the second thread supporting shaft stepwise by a predetermined pitch, wherein the first connecting member is slidable relative to at least one of the first side plate and the third side plate in the longitudinal direction, and the second connecting member is slidable relative to at least one of the second side plate and the fourth side plate in the longitudinal direction.

9. The beading loom according to claim 8, wherein the length adjustment mechanism includes a plurality of grooves arranged at a predetermined pitch in the longitudinal direction and a protrusion for fitting in the grooves.

10. The beading loom according to claim 9, wherein the grooves are provided at the first connecting member and the protrusion is provided at the first side plate.

11. The beading loom according to claim 9, wherein the grooves are provided at the first side plate and the protrusion is provided at the first connecting member.

12. The beading loom according to claim 11, wherein the grooves are connected to each other in the longitudinal direction and each has a V-shaped cross section, the protrusion having a V-shaped cross section corresponding to the V-shaped cross section of the grooves.

13. The beading loom according to claim 12, wherein the length adjustment mechanism includes an elongated hole provided at the first side plate and elongated in the longitudinal direction, a threaded hole provided at the first connecting member and facing the elongated hole, and a clamp bolt to be screwed into the threaded hole via the elongated hole.

14. The beading loom according to claim 13, wherein the protrusion is provided on an outer side of the first connecting member in the lateral direction, an inner side of the first side plate in the lateral direction is formed with a guide groove for receiving the first connecting member movably in the longitudinal direction, and the grooves are formed at a bottom of the guide groove.

15. The beading loom according to claim 14, wherein the elongated hole is formed so as to cross the grooves, and the threaded hole is formed at a position corresponding to the protrusion as viewed in the lateral direction.

16. The beading loom according to claim 15, wherein an outer side of the first side plate in the lateral direction is provided with a plurality of marks at positions corresponding to the grooves.

17. The beading loom according to claim 11, wherein the first connecting member is provided with an additional protrusion spaced apart from the protrusion in the longitudinal direction.

* * * * *